United States Patent [19]

Nohira et al.

[11] 4,170,973

[45] Oct. 16, 1979

[54] EXHAUST GAS RECIRCULATION SYSTEM OF AN INTERNAL COMBUSTION ENGINE

[75] Inventors: Hidetaka Nohira, Mishima; Kiyoshi Kobashi, Susono; Jiro Nakano, Toyota, all of Japan

[73] Assignee: Toyota Jidosha Kogyo Kabushiki Kaisha, Toyota, Japan

[21] Appl. No.: 849,556

[22] Filed: Nov. 8, 1977

[30] Foreign Application Priority Data

Jul. 11, 1977 [JP] Japan ..... 52-82043

[51] Int. Cl.[2] ..... F02M 25/06

[52] U.S. Cl. ..... 123/119 A

[58] Field of Search ..... 123/119 A, 32 EA, 32 EB; 364/442

[56] References Cited

U.S. PATENT DOCUMENTS

| | | | |
|---|---|---|---|
| 3,884,200 | 5/1975 | Caldwell | 123/119 A |
| 3,928,966 | 12/1975 | Goto | 123/119 A |
| 3,963,011 | 6/1976 | Saito | 123/119 A |
| 3,969,614 | 7/1976 | Moyer | 123/119 A |
| 3,970,061 | 7/1976 | Caldwell | 123/119 A |
| 3,982,395 | 9/1976 | Hasegawa | 123/119 A |
| 4,050,429 | 9/1977 | Yasuhiro | 123/119 A |
| 4,128,885 | 12/1978 | Valek | 364/442 |

OTHER PUBLICATIONS

"Electronic Fuel Injection Reduces Automotive Pollution", by M. Williams; Electronics, Sep. 11, 1972, pp. 121-125.

*Primary Examiner*—Bernard Konick
*Assistant Examiner*—Alan Faber
*Attorney, Agent, or Firm*—Stevens, Davis, Miller & Mosher

[57] ABSTRACT

Disclosed is an EGR system of an internal combustion engine, in which a part of the exhaust gas is drawn out from an exhaust pipe and returned to an intake pipe through a control valve, and a reference pressure in the intake pipe corresponding to the amount of recirculated exhaust gas, predetermined by experiment (beforehand) in various combinations of engine intake air flow and speed, is memorized in a memorizing device. The reference pressure responding to the amount of sucked air being introduced into the engine and the engine rotating speed in the case of actual operation of the engine is read out from the memorizing device and, then, compared with the real pressure in the intake pipe in the case of actual operation of the engine. The control valve has a diaphragm chamber, into which positive or negative pressure is introduced, which pressure is controlled by a solenoid valve actuated by a signal from a control device so as to make the real intake pipe pressure coincide with the reference intake pipe pressure.

3 Claims, 12 Drawing Figures

EXHAUST GAS RECIRCULATION SYSTEM OF AN INTERNAL COMBUSTION ENGINE

BACKGROUND OF THE INVENTION

This invention relates to an exhaust gas recirculation system of an internal combustion engine, in which a part of the exhaust gas is drawn out from an exhaust pipe and returned to an intake passage, hereinafter simply referred to as EGR system. More particularly, this invention relates to an EGR system having means for controlling an EGR valve, by which means it is possible to keep the actual amount of EGR gas coincide with the optimum amount which is predetermined by experiment.

In order to reduce noxious oxides of nitrogen in exhaust gas to improve engine performance, such as fuel consumption, and engine stability etc., it is necessary to control the amount of EGR gas in conformity with the engine operating condition. Recently, an electronic control system having a memorizing device has been developed. An EGR valve is directly or indirectly controlled by an electric signal from said control system. In the course of development and accomplishment of this electronic control system, a significant problem, that is to say, the problem of what sensors are to be selected for detection engine operating conditions and how to constitute an actuator for controlling an EGR valve, has took place. Known from prior art are a few kind of actuators for controlling an EGR valve. One of these known actuators is a so-called butterfly valve type system in which an EGR valve is directly driven by a pulse motor and the like. A feed back system is also known, in which a diaphragm type EGR valve is driven with positive pressure which is controlled through bleeding it to the atmosphere by means of a solenoid valve, a position sensing device attached to the EGR valve senses the valve opening position thereof and, then, the opening position of the EGR valve is feedback controlled by comparing it with a memorized valve.

The butterfly valve type system using a pulse motor or the like is, however, lacking in responsiveness and heat resistivity, because the EGR valve must control EGR gas, which has a high temperature, generates pulsatory motion and contains fine particles, fine water moisture and the like. Therefore, the EGR valve requires significantly strict conditions concerning controllability, heat resistivity, durability and the like. The feedback EGR valve control system having a position sensing device is bulky due to mounting of the position sensor thereon and also lacking in resistivity to heat and vibration.

An object of the present invention is to provide an EGR system of an internal combustion engine which obviates the disadvantage mentioned above.

An another object of the present invention is to provide an EGR system of an internal combustion engine in which a mechanical valve, particularly a diaphragm valve as its original construction or its minor modified construction, is used as an EGR valve for directly controlling EGR gas, and in which, in order to actuate said diaphragm valve, a pressure modulating valve is also provided in a pipeline for introducing positive or negative pressure into said diaphragm valve, so that, by means of said pressure modulating valve, the positive or negative pressure being introduced into said diaphragm valve is bled into the atmosphere in accordance with the electrical signal from a control device.

BRIEF DESCRIPTION OF THE DRAWINGS

FIGS. 6-1, 6-2 and 6-3 are schematic views illustrating the embodiments of pipelines connecting the solenoid valve to the EGR valve shown in FIGS. 1 or 4;

DESCRIPTION OF THE PREFERRED EMBODIMENT

Figure 1:
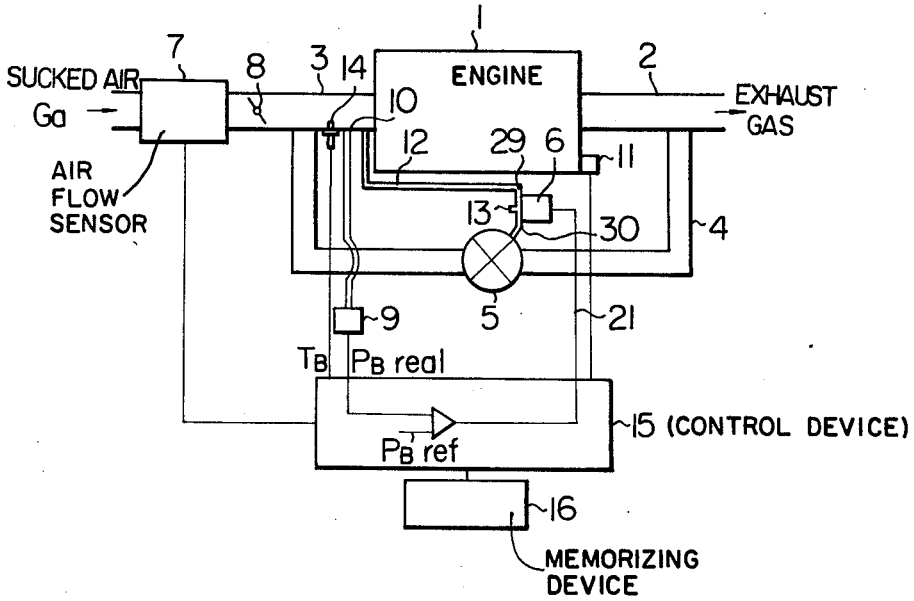
FIG. 1 is a schematic view of an EGR system of an internal combustion engine and a control system thereof.

Referring now to FIG. 1, an EGR system of an internal combustion engine and a control system thereof are illustrated. Between an exhaust pipe 2 of an engine 1 and an intake pipe 3 there is provided an EGR pipe 4, which draws out a part of the exhaust gas from the exhaust pipe 2 and returns it to the intake pipe 3. The amount of EGR gas is controlled by changing the cross-sectional area of the EGR pipe 4 by means of a diaphragm type EGR valve 5. Vacuum is introduced into this valve 5 from the intake pipe 4 through a pressure conduit 12 and a pressure modulating valve 6, which is connected to three pressure ports. The first port is an atmosphere bleed port 13, the second port is a pressure signal inlet port 29 and the third port is a pressure signal outlet port 30. The ports 29 and 30 are respectively connected to the intake pipe 3 and the EGR valve 5. When a signal from a control device 15 is applied to the pressure modulating valve 6, air is bled from the atmosphere bleed port 13 into the EGR valve 5. A sensor 7 for detecting the amount of the sucked air (air flow sensor) being introduced into the engine is provided at the upstream side of a throttle valve 8 of the intake pipe 3 and a port 10 is provided at the downstream side thereof. A pressure sensor 9 is provided on a pipe connected to the port 10. A temperature sensor 14 is provided in the intake pipe 3. A sensor 11 for detecting the engine rotating speed is also mounted on a suitable position of the engine.

The sensors 7, 9, 11 and 14 detect the amount of the sucked air, the pressure in the intake pipe, the engine rotating speed and the temperature of the sucked air, respectively, and, then, signals of these values are input into the control device 15. A memorizing device 16 is connected to the control device 15. An electrical signal line 21 connects the pressure modulating valve 6 to the control device 15.

Figure 2:
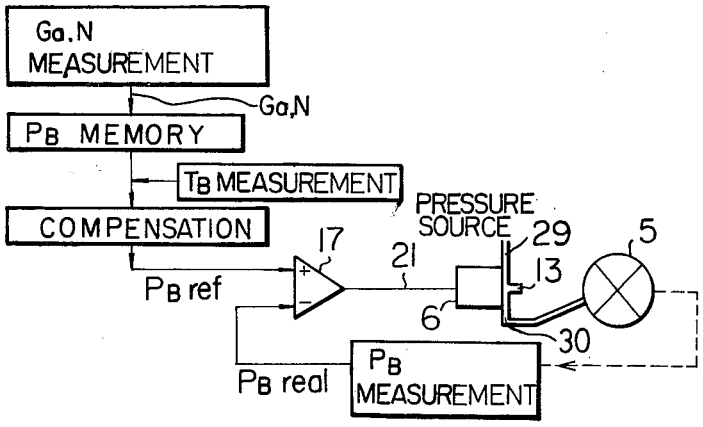
FIG. 2 is a block diagram illustrating the process for controlling the amount of EGR gas.

FIG. 2 is a block diagram illustrating the process of controlling the amount of EGR gas according to this invention.

Figure 3:
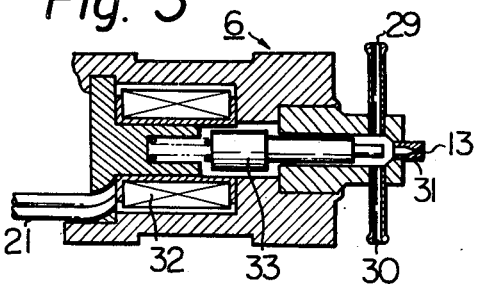
FIG. 3 is a cross-sectional view of a solenoid valve used as a pressure modulating valve.

FIG. 3 is a cross-sectional view of a solenoid valve used as a pressure modulating valve, to which an electrical signal line 21 and a coil 32 are connected. A shaft 33 is moved by means of the coil 32 to the left and right, in FIG. 3, so as to control the air bled from the atmosphere bleed port 13. A well known three-way-type solenoid valve may be used in place of the solenoid valve as shown in FIG. 3. In order to change the pulse signal of positive or negative pressure from the pressure signal inlet port 29 to an analogue signal and transmit it to the EGR valve 5 through the pressure signal outlet port 30, a stationary choke orifice 31 is disposed in the atmosphere bleed port 13 of the solenoid valve 6.

Figure 4:
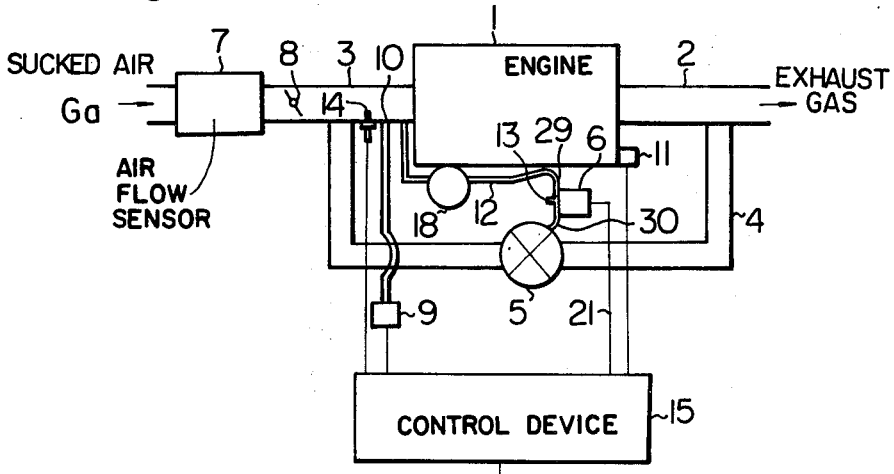
FIG. 4 is a schematic view showing a control system employing a vacuum pump for controlling the EGR system shown in FIG. 1.
Figure 5:
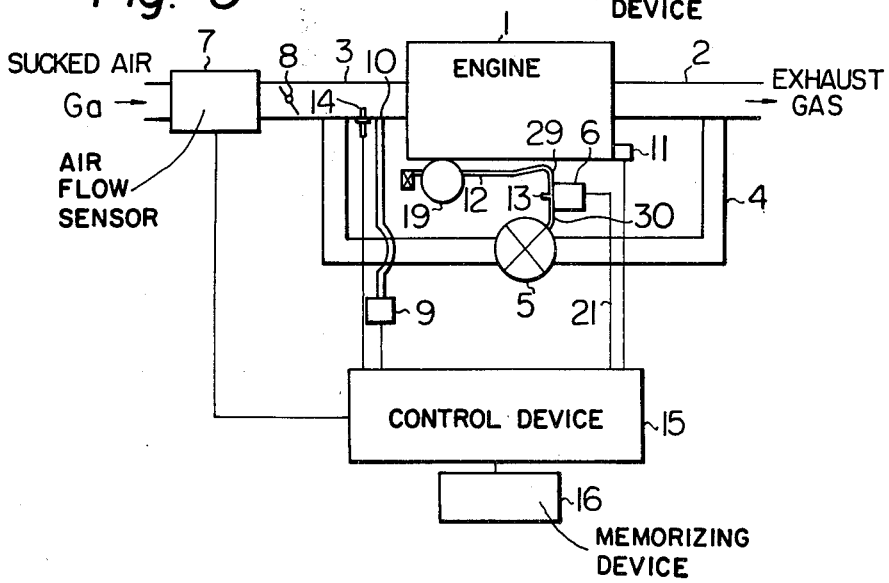
FIG. 5 is a schematic view showing a control system employing an air pump for controlling the EGR system shown in FIG. 1.

FIGS. 4 and 5 are schematic views showing EGR gas control systems, in which a vacuum pump 18 (FIG. 4) and an air pump 19 (FIG. 5) are provided, respectively, in the pressure conduit 12, which communicates the pressure modulating valve 6 with the intake pipe 3.

Figures 1, 6:
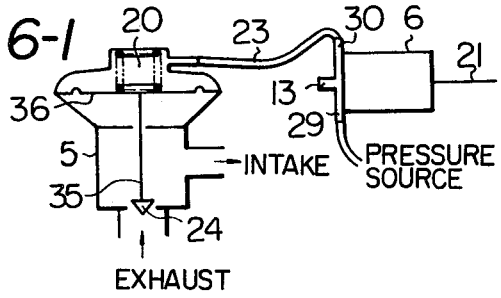
Figures 2, 6:
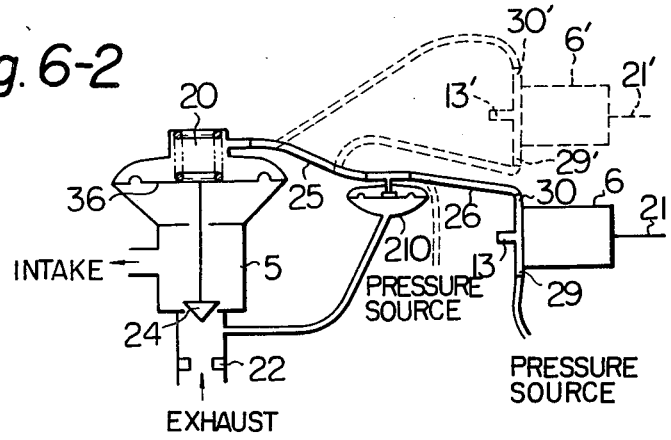
Figures 3, 6:
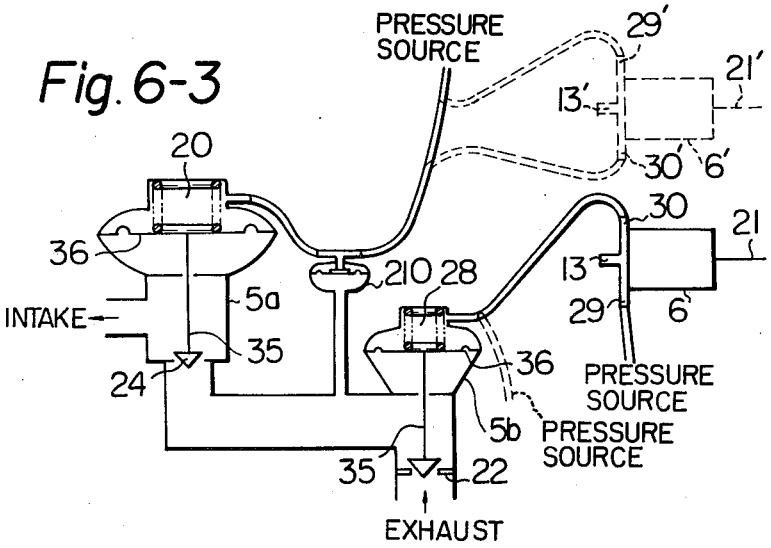

FIG. 6-1 is a schematic view illustrating an embodiment of the pipeline connecting the solenoid valve 6 to the EGR valve 5 and transmitting the pressure signal from the solenoid valve 6 to the EGR valve 5. In this embodiment, a diaphragm chamber (vacuum chamber) 20 and the pressure modulating valve 6 are connected by means of a vacuum hose 23. The EGR valve 5 has a valve rod 35 rigidly secured to a diaphragm 36. To this valve rod 35 a valve body 24 is rigidly secured. When vacuum is introduced into the vacuum chamber 20, the valve body 24 moves upwardly in the drawing to change the cross-sectional area of the valve passage.

FIG. 6-2 is a schematic view illustraling another embodiment of the pipeline, in which embodiment a control orifice 22 is provided in the EGR valve 5 at the side of the exhaust pipe and a modulator 210 is provided in order to detect the pressure in the pipeline between the valve 24 and said control orifice 22. A vacuum hose 25 connects the vacuum chamber 20 to the modulator 210 and a vacuum hose 26 connects the modulator 210 to the pressure modulating valve 6. Otherwise, the vacuum chamber 20 and a pressure modulating valve 6', and the valve 6' and the modulator 210 are respectively connected by means of vacuum hoses, and the modulator 210 and a vacuum source are connected by means of another vacuum hose, as shown by a dashed line in FIG. 6-2.

FIG. 6-3 is a schematic view of still another embodiment of a pipeline, which connects an EGR valve **5*a* and a second EGR valve 5*b* to the pressure modulating valve 6, similar to the embodiments shown in FIGS. 6-1 and 6-2. In this embodiment, an EGR valve 5*b* is added to the EGR system shown in FIG. 6-2, in order to change the cross-sectional area of the passage of the control orifice 22. In this embodiment of an EGR system, a vacuum chamber 28 of the second EGR valve 5*b* and one side of the pressure modulating valve 6, and the other side of the changing valve 6 and a vacuum source are respectively connected by means of vacuum hoses. One side of the modulator 210 is connected to the vacuum chamber 20 of the EGR valve 5*a* and the other side thereof is connected to a vacuum source, respectively, by means of vacuum hoses. Otherwise, the vacuum chamber 28 of the second EGR valve 5*b* is directly connected to a vacuum source by means of a vacuum hose, and a pressure modulating valve 6' is provided in the vacuum hose connecting the modulator 21 to a vacuum source, through which pressure modulating valve 6'*a* vacuum passes, as shown by a dashed line in FIG. 6-3**.

According to the EGR system of this invention, the cross-sectional area of the valve opening of the EGR valve is changed and controlled by actuating the pressure modulating valve 6, which is provided between the EGR valve and the positive or negative pressure source and supplies positive or negative pressure to the EGR valve. In order to control the amount of EGR gas, the pressure modulating valve 6 is controlled in accordance with the output signal from the control device 15, which signal responds to three types of information, that is to say, the amount of the sucked air (Ga), the pressure (Pb.real) in the intake pipe and the engine rotating speed (N). The controlling process according to this invention and the relationship between the EGR valve 5 and the pressure modulating valve 6 will now be described with reference to FIG. 2 and FIGS. 6-1 through 6-3.

(1) The optimum amount of EGR gas is determined by experiment in various combinations of the amount (Ga) of sucked air and the engine rotating speed (N). The compensating value of the optimum amount of EGR gas, considering the change of the intake pipe pressure which occurs with the temperature in the intake pipe, is also experimentally determined. Said optimum amount of EGR gas and compensating value are memorized in the memorizing device 16.

(2) The amount of sucked air (Ga) being introduced into the engine and the engine rotating speed (N) in the case of actual engine operation are measured. The reference pressure in the intake pipe (Pb. ref.) responding to the values of Ga and N is read out from said memorizing device 16.

(3) The pressure in the intake pipe (Pb. ref.) read out from said memorizing device 16 and the real pressure in the intake pipe (Pb. real) measured downstream of the throttle valve 8 of the intake pipe 3 are compared by means of a comparator 17 shown in FIG. 2. So as to make Pb real coincide with Pb ref., the EGR valve 5 is feedback controlled by means of the pressure modulating valve 6, which is provided in the conduit between the EGR valve 5 and the positive or negative pressure source (in the conduit 12 for introducing vacuum, in the embodiment shown in FIG. 1), by which a part of positive or negative pressure being introduced into the EGR valve 5 is bled into the atmosphere and, then, the positive or negative pressure is introduced into the EGR valve 5.

(4) The operation of the embodiment shown in FIG. 6-1, in which an EGR valve 5 operated with vacuum is used, is the same as that of the embodiment shown in FIGS. 1 and 2.

Figure 7:
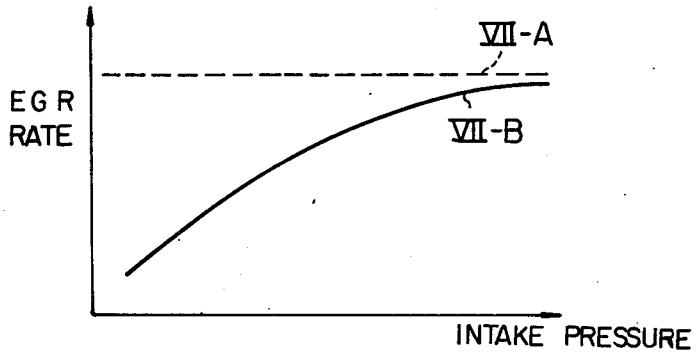
FIGS. 7 and 8 are diagrams illustrating the characteristics of the EGR rate in the case of the pipeline connecting methods shown in FIG. 6-2 and FIG. 6-3, respectively.

(5) The operation of the embodiment shown in FIG. 6-2 is basically the same as that of the embodiment shown in FIG. 6-1. However, if there is no pressure modulating valve 6 or 6' (the EGR rate in that case is shown as VII-A in FIG. 7), the EGR system is controlled by a modulator 210 so as to obtain a constant EGR rate with regard to the range of engine rotating speed. If a pressure modulating valve 6 or 6' is provided in the EGR system which is controlled by the control device 15, a part of the positive or negative pressure being introduced into the EGR valve 5 is bled into the atmosphere by means of the pressure modulating valve 6 or 6', which results in rapid control of the desired EGR rate (the EGR rate in that case is shown as VII-B in FIG. 7).

Figure 8:
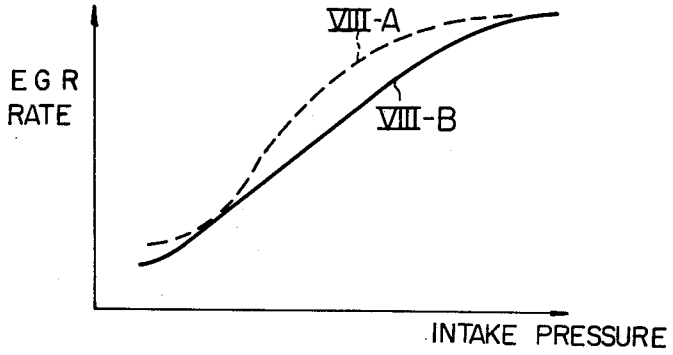

(6) The operation of the embodiment shown in FIG. 6-3 is basically the same as that of the embodiment shown in FIG. 6-1. However, when the EGR rate in the case of no pressure modulating valve (said EGR rate is shown as VIII-A in FIG. 8) closely resembles the required EGR rate, if there is provided a pressure modulating valve 6 or 6', it is possible to limit the control range of the control device 15 and rapidly and acurately control the EGR rate (said EGR rate controlled by the pressure modulating valve 6 or 6' is shown as VIII-B in FIG. 8).

(7) The pressure modulating valve or solenoid valve 6 shown in FIG. 3 must be operated by an electrical signal having relatively low frequency due to the durability of the pressure modulating valve. However, if the electrical frequency is too low, the required pressure for responding to the change of engine operating conditions cannot be obtained. Even if the electrical signal has a normal range of frequency, due to the significant pulsatory motion of the pressure being introduced into the EGR valve 5, the valve body 24 of the EGR valve 5 also vibrates, which results in intermittent introduction of EGR gas into the intake passage. Therefore, it is necessary to maintain the electrical signal at a constant frequency, to actuate the solenoid valve 6 with an ON or OFF signal and to control the EGR gas.

(8) If necessary, it is possible to actuate the solenoid valve 6 and control the EGR gas by changing the ratio of the interval of ON or OFF signal having a predetermined constant frequency in place of the above-mentioned ON or OFF signal.

The present invention is characterized in that an actuator of EGR valve is separated into two means, i.e. means (pressure modulating valve 6) being controlled by an electrical signal and an EGR valve 5 for controlling the EGR gas itself, that the means for actuating the EGR valve is limited to a solenoid valve, and that the kinds of electrical signal is limited.

Figure 9:
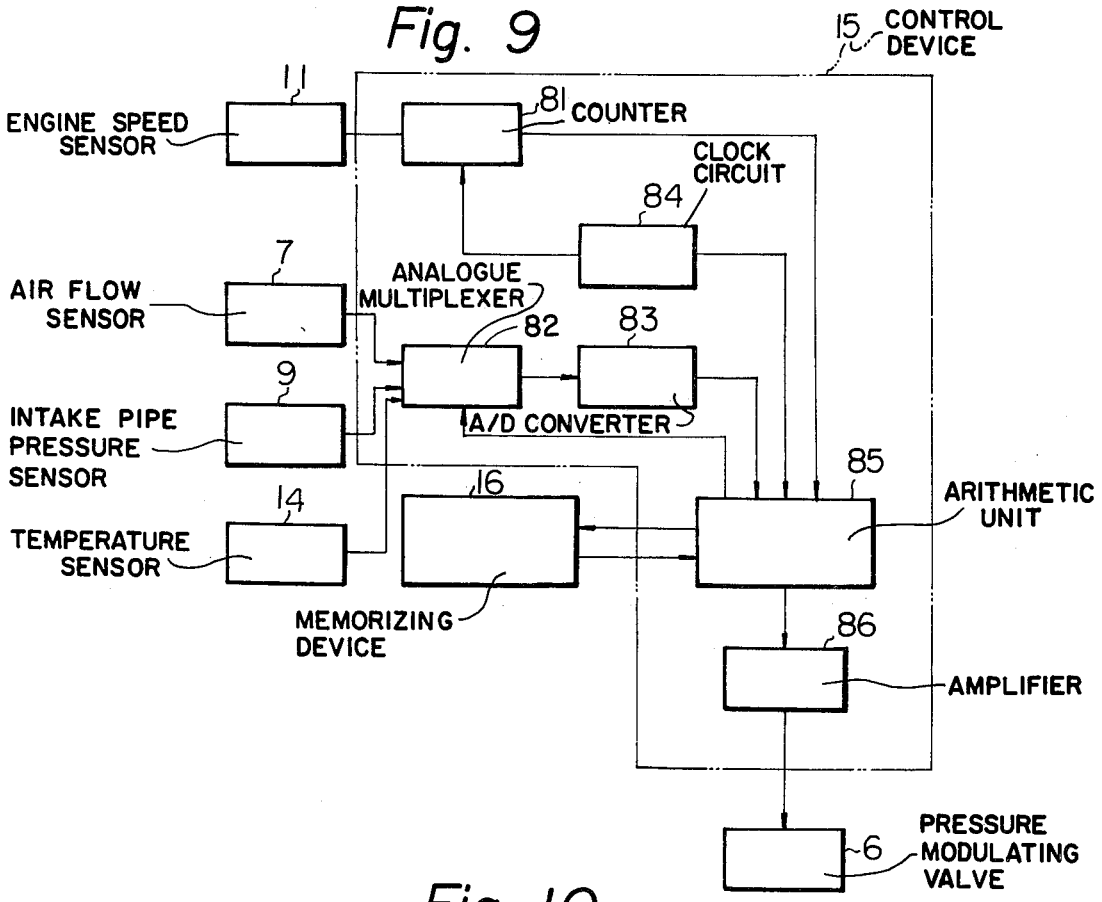
FIG. 9 is a block diagram illustrating an embodiment of the control system of the present invention.

FIG. 9 is a block diagram illustrating an embodiment of the control system of this invention. A counter 81 counts the pulse of the signal from the engine rotating speed sensor 11, which pulse is input to the counter 81 in every pulse length being supplied from a clock circuit 84 at the predetermined time interval. Then, the counter 81 reads out the engine rotating speed.

An analogue multiplexer 82 deals with and divides, at predetermined time intervals, the output signals from the sensor 7 for detecting the amount of sucked air, the intake pipe pressure sensor 9 and the temperature sensor 14, in accordance with instructions from an arithmetic unit 85, and introduces said output signals into an A/D converter 83. The arithmetic unit 85 performs the required calculation on the basis of the engine rotating speed and the amount of sucked air converted to digital value, and reads out the intake pipe pressure (Pb. ref.) corresponding to these values. The real intake pipe pressure (Pb. real), detected by the intake pipe pressure sensor 9 and converted to digital value by the A/D converter 83, is introduced into the arithmetic unit 85 and, then, (Pb. real) is synchronized with the clock signal with predetermined frequency being supplied from the clock circuit 84 and compared with the reference intake pipe pressure (Pb. ref.). The arithmetic unit 85 supplies the logical output of 1 or 0 into an amplifier 86 in accordance with the large or small relationship between (Pb. real) and (Pb. ref.). Then, the pressure modulating valve 6 is operated in accordance with the ON-OFF operating signal from the amplifier 86, which signal corresponds to said reference output signal.

Figure 10:
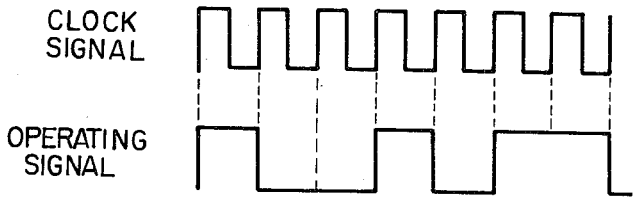
FIG. 10 is a timing chart illustrating the changes of the clock signal and operating signal with respect to time in the control system of the present invention.

FIG. 10 is a timing chart illustrating the change of the clock signaland operating signal in the control system of this invention. The rising edges of clock signal is triggered and the comparison of (Pb. real) and (Pb. ref.) is performed. Then, the relationship of large or small between said values is output in the form of a logical signal, which is, then, electrically amplified and to be an operating signal.

What is claimed is:

1. An exhaust gas recirulation system of an internal combustion engine, in which a part of the exhaust gas of the internal combustion engine is drawn out from an exhaust pipe and returned to an intake pipe through a control valve; said system comprising:

a memorizing device which memorizes the reference pressure (Pb ref.) in the intake pipe corresponding to the optimum amount of recirculation exhaust gas experimentally determined for different combinations of the amount of sucked air (Ga) being introduced into the internal combustion engine and the engine rotating speed (N);

means for detecting the amount of sucked air (Ga) being introduced into the internal combustion engine, the engine rotating speed (N) and the pressure (Pb real) in the intake pipe, during actual operation of the engine;

means for reading out the reference pressure (Pb ref.) in the intake pipe from said memorizing device in accordance with the actually detected amount of sucked air (Ga) and engine rotating speed (N);

means for comparing the actually detected pressure (Pb real) in the intake pipe with the read out reference pressure (Pb ref.) in the intake pipe, and for generating an electrical signal in accordance with the difference therebetween; and means for actuating said control valve so as to make the actually detected pressure (Pb real) coincide with the read out reference pressure (Pb ref.) in accordance with said electrical signal.

2. An exhaust gas recirculation system as set forth in claim 1, wherein said control valve comprises a diaphragm, a diaphragm chamber into which a positive or negative pressure is introduced, and a valve body secured to said diaphragm for changing the cross-sectional area of said control valve, and said actuating means comprises:

a solenoid valve operating as a pressure modulating valve and arranged in a pressure pipe for introducing a positive or negative pressure into said diaphragm chamber;

a pressure source for supplying a positive or negative pressure to said solenoid valve; and said solenoid valve being actuated by an electrical signal so as to control the positive or negative pressure being transmitted to said diaphragm chamber.

3. An exhaust gas recirculation system as set forth in claim 2, wherein in order to change an intermittent signal of positive or negative pressure supplied from said pressure source to an analogue signal and, then, introduce it into said diaphragm chamber, said solenoid valve has an atmospheric bleed port having a control orifice therein.

* * * * *